United States Patent [19]

Bobleter et al.

[11] 4,106,894

[45] Aug. 15, 1978

[54] APPARATUS FOR HEAT TREATING FRAGMENTED MATERIALS

[75] Inventors: André Henri-Robert Bobleter, Villeneuve-St. Georges; Jacques Louis-Paul Simonnet, Chevreuse, both of France

[73] Assignees: Bertin & Cie, Plaisir; Affimet, Paris, both of ; FRX

[21] Appl. No.: 750,807

[22] Filed: Dec. 15, 1976

[30] Foreign Application Priority Data

Dec. 19, 1975 [FR] France ..... 75 38970

[51] Int. Cl.[2] ..... F27B 9/14

[52] U.S. Cl. ..... 432/122; 266/214; 432/145; 432/5

[58] Field of Search ..... 432/5, 7, 9, 11, 93, 432/124, 120–123, 144, 145, 136, 141, 148, 162, 153, 154, 179–181, 231, 232, 234, 261; 266/177, 214

[56] References Cited

U.S. PATENT DOCUMENTS

| | | | |
|---|---|---|---|
| 587,398 | 8/1897 | O'Connor | 432/141 |
| 2,196,321 | 4/1940 | Morton et al. | 432/181 |
| 2,899,189 | 8/1959 | Matis et al. | 432/145 |
| 3,219,439 | 11/1965 | Longenecker | 266/214 |
| 3,804,584 | 4/1974 | Herr | 432/234 |
| 3,905,758 | 9/1975 | Moussou et al. | 432/11 |
| 4,028,048 | 6/1977 | Woolworth | 432/83 |

*Primary Examiner*—John J. Camby
*Assistant Examiner*—Henry C. Yuen
*Attorney, Agent, or Firm*—Dennison, Dennison, Meserole & Pollack

[57] ABSTRACT

Apparatus for heating elements broken up in small pieces wherein the pieces are loaded into baskets with solid vertical walls and perforated or porous bases, and are pushed in a continuous line into a tunnel to there introduce a hot gas which passes vertically through each basket and its contents. A principal application is the preheating of products feeding a smelting or re-smelting furnace, and in this case the hot gases used are fumes from the furnace.

6 Claims, 3 Drawing Figures

APPARATUS FOR HEAT TREATING FRAGMENTED MATERIALS

The present invention concerns the treatment of fragmented materials in a "tunnel" type furnace. The apparatus disclosed is used in a process characterized by the use of hot gases circulating through the fragmented materials, and these hot gases can be fumes issuing from a smelting furnace.

By way of example, a "reverberatory" type smelting furnace, heated by 800 N $m^3$/hr with natural gas, 11 tons/hour of fumes at 1150° C are used, and can heat continuously, or intermittently, 7 tons/hour of materials, from 20° C up to 500° to 600° C. The exchange of heat which is effected by radiation in traditional furnaces is effected principally by convection in the present invention.

Use is made of the fact that the materials to be treated are in divided form which engenders large surfaces for exchange per unit of volume. If the thermal exchange coefficient between the hot gases and the particles remains low enough, this inconvenience is greatly compensated by the very great surface for heat exchange which thus permits the passage of a great heat flow.

The invention is characterized by the following key points: (1) the materials to be treated are contained in baskets circulated in a tunnel furnace: (2) hot gases from a smelting furnace are used; (3) the furnace and baskets are sealed together to avoid heat losses; (4) the baskets are moved in a closed circuit; and (5) the hot gases flow in a closed circuit.

The following description, relative to the attached drawings, gives a nonlimiting example of the invention and its particular features.

Figure 1:
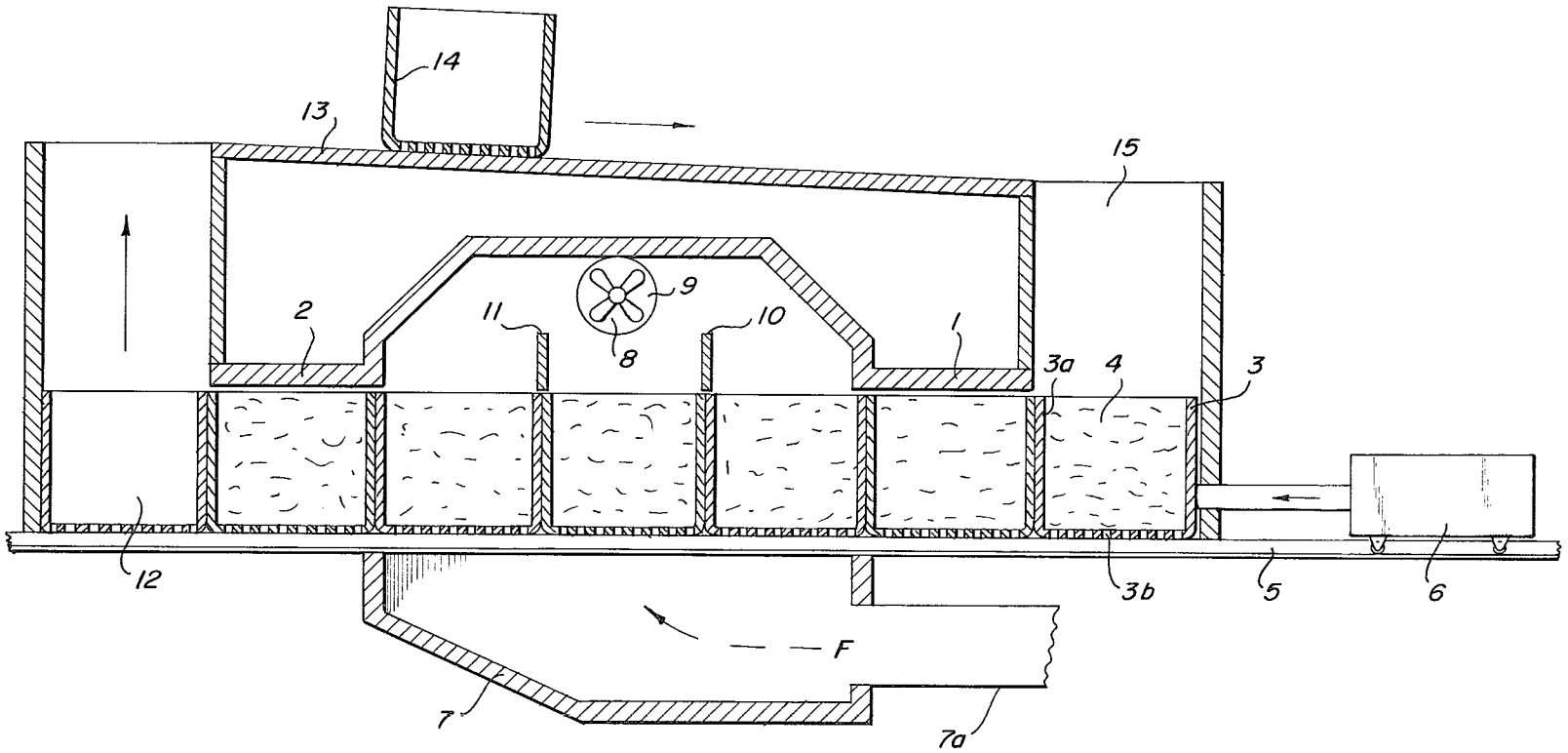
FIG. 1 is a longitudinal cross section of apparatus used in carrying out the described process.

The furnace (FIG. 1) is comprised of an input chamber 1 and a discharge chamber 2, to permit passage of baskets 3 containing materials 4 to be treated. These baskets, of identical dimensions, are joined and rest on two parallel rails 5,5' mounted on the flue 7 of the furnace and are pushed by means of any known prior art devices, for example rams 6.

These baskets are formed of four vertical solid panels 3*a* and a permeable horizontal base 3*b*, shown for example as a grill or it may be perforated sheet metal, so that the hot gases coming from a smelting furnace or the like through the conduit 7*a* can pass through the base of the baskets and through the materials to be treated.

A ventilation device 8 of any form contributes to the passage of the gases in the direction of arrow F. This device is mounted preferably upstream from the circuit in the main conduit 9 so that for safety reasons the furnace is under subpressure and so that the ventilator moves the less hot gases.

The direction of movement of the baskets, shown in FIG. 1, is the same as the hot gases in the direction of arrow F, and is only shown as an example as the invention foresees inlet of gases in the opposite direction as well and on either side of the furnace.

The perforation of base 3*b* of the baskets should be formed so that the materials to be treated cannot escape, and to create only the minimum loss of heat in the passage of the hot gases. This ideal situation would be true only if all of the baskets in the furnace at the same time contained loads having the same permeability and the same bed thickness.

In fact, this condition cannot always be filled. Heterogenous loads sometimes create different permeabilities to the passage of the gases through the baskets, and as a result the treatment of the materials is no longer homogenous from basket to basket because of passages called chimneys which are formed through a basket.

To avoid this inconvenience, the invention discloses forming of the permeability of the base of the baskets so that the high pressure drop in the gas stream is about equal for each basket. The desired permeability can be realized by controlling the mesh of the grill or the pierced holes of the perforated sheet which constitutes the base of the basket. On the other hand, the transverse barriers 10 and 11, mounted at intervals to correspond to the length of the baskets, limit the preferential passages of gases into the collection circuit. For this effect, the bottom edge of each of these barriers 10 is placed in the immediate proximity of the panels 3*a*.

Figure 2:
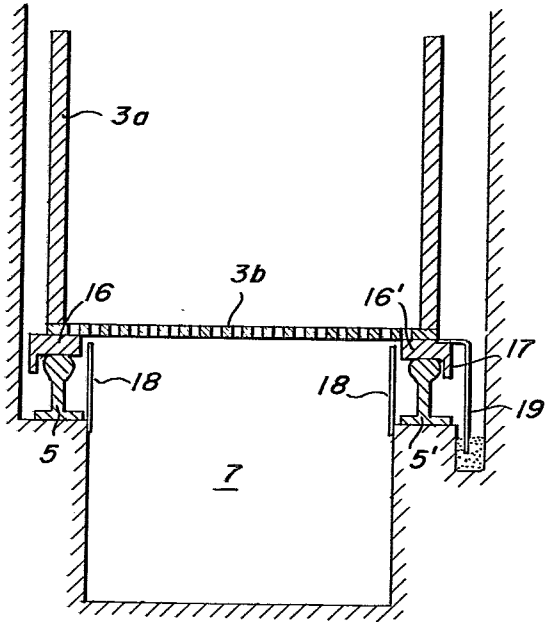
FIG. 2 is a transverse cross section of a basket, showing its mounting in the furnace.

FIG. 2 illustrates the mounting to permit sliding of baskets 3 on rails 5–5'. To facilitate this sliding, two cast iron blocks 16–16' are interposed between the rail and the basket, attached under the basket. These blocks each have a lateral depending guide shoulder 17 and they can be protected from the heat by deflectors such as the screens 18 mounted on furnace flue 7.

If the temperature in the furnace is to be raised to the point where the seizing between the blocks of the baskets and the rails of the furnace would be weakened, a gaseous or liquid coolant fluid can be circulated within the rails, and these rails can then take the form of simple tubes.

If blocks 16 are continuous along the basket the longitudinal seal to the hot gases will be assured. If these blocks are not continuous, or if they are replaced by rollers, the seal is obtained by a system of joints, for example the device known as a sand joint 19 shown in one embodiment to the right in FIG. 2.

Figure 3:
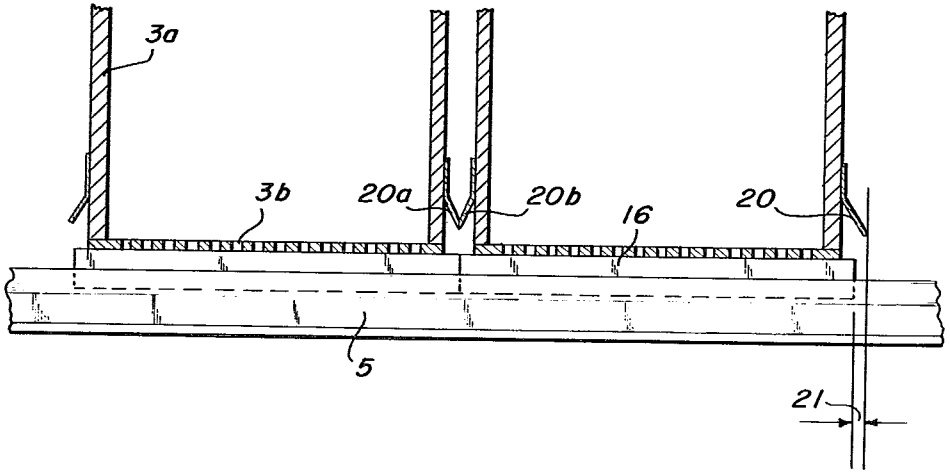
FIG. 3 is a longitudinal cross section of two consecutive baskets, showing a sealing device between the baskets.

The seal between two consecutive baskets (FIG. 3), can be formed by a device with transverse joints, for example the deformable tabs 20 mounted all along the vertical panels in front of and/or behind the baskets. At rest, the tab extends beyond the end of blocks 16 (and also lateral joints 19) a distance 21 (FIG. 3). When two baskets are engaged on blocks 16, the contact of tabs 20*a* and 20*b* is assured by the contact of the tabs due to the removal of this interval 21.

The seal of the furnace per se is assured by inlet chamber 1 and discharge chamber 2 (FIG. 1), both formed by a ceiling in the immediate proximity of solid vertical panels 3*a*, and of length at least equal to that of each basket, and the fitting between the ceiling and a basket procures the seal of the furnace from the outside.

The invention provides a complement to the general installation which comprises the loading, and, if desired, also the weighing of the baskets at the input into the furnace, the unloading at discharge and transport of the empty baskets from the unloading position to loading position.

FIG. 1 is a general diagram of this installation, which functions as follows: Any prior art control device, not shown, loads the basket 3 and then weighs it. After the weight is determined, ram 6 pushes basket 3 to the left in the drawing, by pushing the whole row of baskets, so that each basket passes successively and by steps into inlet chamber 1, into the tunnel furnace itself, and into discharge chamber 2, until it reaches the unloading position 12.

The control devices, not shown, allow the basket to tilt for unloading in position 12, then to be raised up to an inclined ramp 13. This ramp is provided for example with rollers, not shown, which permit the baskets 14 to descend by their own weight toward the area 15 from whence they are lowered into loading position by another device which is not shown.

The vertical transport of the baskets out of the furnace is shown only as a nonlimiting example, and the invention extends to any other such arrangement, especially to lateral transport devices on either side of the furnace.

In the invention, the unloading takes place preferably directly in a smelting furnace which is the generator of the hot treatment gases. For this, the installation is planned such that the unloading floor 12 is arranged exactly over the loading orifice of the smelting furnace and a gas main guides the passage of the materials toward the inlet of said smelting furnace.

In such an application, the fumes issuing from the smelting furnace are generally much too hot to be used directly in a furnace as in the invention. They are cooled by dilution with a certain flow of air or of lower temperature fumes.

For a typical installation some parameters can be given concerning the installation according to the invention. In comparison with the example cited at the beginning of the specification, it is possible, after dilution, to process 18 tons/hour of diluted fumes at 600° C. These fumes could heat a material flow of 7 tons/hour from 20° C to 500° C, distributed on a permeable surface of $10m^2$. These $10m^2$ would be spread out on five baskets measuring 1 meter length, 2 meters width and 1 meter height. Every 6 minutes, the train of baskets would advance the length of one basket.

It is to be noted that the described process includes an intermittent movement of the line of baskets in the heating section of the tunnel furnace. The duration of movement is for example one-tenth of the duration of the rest period. This method is preferable to a slow and regular forward movement for two principal reasons: it permits easier loading and unloading operations, and it permits the transverse barriers in the main flue to play their role in distributing the flow between baskets because of their position opposite the front and rear ends of the baskets when they are at rest.

In the case of continuous movement, it is necessary to multiply the number of barriers considerably to obtain analogous distribution.

We claim:

1. A furnace system for the heat treatment of fragmented materials, comprising, an elongated heating tunnel having smooth sides, a bottom flue in communication with said tunnel for the introduction of hot gases thereto and a top flue for collection and exhaustion of cooled gases, a basket inlet chamber having a solid ceiling at one end of said tunnel, a basket outlet chamber having a solid ceiling at the other end of said tunnel, rail means extending through the length of said tunnel, a plurality of baskets mounted on said rail means for carrying the materials to be treated through the tunnel, said baskets having solid vertical sides and a gas permeable base, an metallic slide block on the bottom of each basket in contact with the rail means and serving as a gas seal, and means for moving said baskets through said tunnel.

2. A furnace system as defined in claim 1 and further including deformable seal means on the end of each basket which cooperate with the like seal means on the adjacent basket to prevent passage of hot gas.

3. A furnace system as defined in claim 1 wherein the means for moving said baskets consists of a fluid pressure ram.

4. A furnace system as defined in claim 1 and further including an exhaust ventilator fan in said top flue.

5. A furnace system as defined in claim 1 and further including transverse barriers in the top flue spaced apart approximately the length of a basket.

6. A furnace system as defined in claim 1 and further including means for conveying said baskets from the basket outlet chamber back to the basket inlet chamber.

* * * * *